US006769597B1

(12) United States Patent
Seizu

(10) Patent No.: US 6,769,597 B1
(45) Date of Patent: Aug. 3, 2004

(54) BENT WORK AND BENDING METHOD AND BENDING DEVICE USED THEREFOR

(75) Inventor: Kiyoshi Seizu, Osaka (JP)

(73) Assignee: Miharu Co., Ltd., Sakai (JP)

( * ) Notice: Subject to any disclaimer, the term of this patent is extended or adjusted under 35 U.S.C. 154(b) by 0 days.

(21) Appl. No.: 09/705,750

(22) Filed: Nov. 6, 2000

(30) Foreign Application Priority Data

Aug. 29, 2000 (JP) ..... 2000-259811

(51) Int. Cl.[7] ..... B21D 39/02
(52) U.S. Cl. ..... 228/152; 228/17.5; 72/166
(58) Field of Search ..... 228/173.3, 173.4, 228/173.5, 173.6, 212, 44.3, 47.1, 144, 152; 72/166, 170, 171

(56) References Cited

U.S. PATENT DOCUMENTS

| | | | | |
|---|---|---|---|---|
| 1,915,312 A | | 6/1933 | Hauf | |
| 3,156,034 A | * | 11/1964 | Gruetjen | 280/781 |
| 3,260,438 A | * | 7/1966 | Bergantini | 228/6.1 |
| 3,724,250 A | * | 4/1973 | Molino | 72/171 |
| 3,826,121 A | * | 7/1974 | Yashiro | 72/170 |
| 3,905,086 A | * | 9/1975 | Tetlak | 228/173.1 |
| 3,905,536 A | * | 9/1975 | Claussen | 219/62 |
| 4,304,114 A | * | 12/1981 | Wiig | 29/894.354 |
| 4,491,004 A | * | 1/1985 | Ivanoff | 72/168 |
| 4,496,097 A | * | 1/1985 | Larsen | 228/212 |
| 4,590,781 A | * | 5/1986 | Toyooka | 228/151 |
| 4,633,698 A | * | 1/1987 | Oetiker | 29/897 |
| 4,811,581 A | * | 3/1989 | Oetiker | 72/11.5 |
| 4,841,802 A | * | 6/1989 | Peck | 228/169 |
| 4,945,743 A | * | 8/1990 | Yasumura et al. | 228/17 |
| 5,301,869 A | * | 4/1994 | Toyooka et al. | 228/147 |
| 5,332,065 A | * | 7/1994 | Steele et al. | 188/18 R |
| 5,566,874 A | * | 10/1996 | Sturrus | 228/17 |
| 5,934,544 A | * | 8/1999 | Lee et al. | 228/146 |
| 6,076,725 A | * | 6/2000 | Imamura et al. | 156/304.5 |

FOREIGN PATENT DOCUMENTS

| | | | |
|---|---|---|---|
| CH | 602214 | | 7/1978 |
| DE | 3529152 A1 | | 4/1986 |
| GB | 2 138 550 A | * | 10/1984 |
| JP | 56-165512 | | 5/1980 |
| JP | 55-32454 | | 8/1980 |
| JP | 57-011731 | | 1/1982 |
| JP | 58-147625 | | 10/1983 |
| JP | 59-34817 | | 3/1984 |
| JP | 59-50935 | | 3/1984 |
| JP | 63-127723 | | 8/1988 |
| JP | 3-42968 | | 6/1991 |
| JP | 03-297519 | | 12/1991 |
| JP | 4-33419 | | 3/1992 |
| JP | 07-185671 | | 7/1995 |
| JP | 07-314050 | | 12/1995 |

OTHER PUBLICATIONS

Japanese Office Action dated Jan. 23, 2003.

* cited by examiner

*Primary Examiner*—Kiley Stoner
*Assistant Examiner*—Jonathan Johnson
(74) *Attorney, Agent, or Firm*—Armstrong, Kratz, Quintos, Hanson & Brooks, LLP

(57) ABSTRACT

A bent work is integrally formed at low cost by bending a belt-shaped thick steel material having an L-shaped cross-section so as to form a cylinder and by welding ends of the belt-shaped thick steel material to each other, the bent work being used as a bearing-receiving unit or the like.

3 Claims, 16 Drawing Sheets

BENT WORK AND BENDING METHOD AND BENDING DEVICE USED THEREFOR

BACKGROUND OF THE INVENTION

1. Field of the Invention

The present invention relates to a bent work to be used as a bearing-receiving unit and the like for construction machinery, a bending method for manufacturing the same, and a bending device to be used therefor.

2. Description of the Related Art

Generally, construction machinery such as a hydraulic shovel includes, as shown in FIG. 19, a lower moving unit 51 and an upper rotational unit 52 rotatably supported by the lower moving unit 51. The upper rotational unit 52 is rotatably mounted on the lower moving unit 51 via a bearing-receiving unit 53 fixed to the lower moving unit 51 and a bearing (not shown) fixing to the bearing-receiving unit 53. As shown in FIGS. 20 to 22, the bearing-receiving unit 53 includes a cylindrical part 54, and a flange 55 protruding toward the outside or outwardly at the upper end of the cylindrical part 54. The flange 55 is provided with a number of through-holes 55*a* (four through-holes 55*a* are shown in FIGS. 20 and 21) formed in the flange 55 for receiving bolts (not shown) for fixing the bearing. The bearing-receiving unit 53 must have a strength sufficient to support the bearing thereon. The cylindrical part 54 and the flange 55 are made of a thick steel plate (the cylindrical part 54 is thinner than the flange 55).

Hitherto, the bearing-receiving unit 53 has been manufactured in a manner such that a first member 57 made of a thick steel plate bent in a cylindrical shape and a second member 58 made of a thick steel plate bent in an annular shape are welded to each other (see FIGS. 23 and 24). In FIG. 24, welds 59 are shown. In FIG. 23, the first and second members 57 and 58 are welded to each other butt-welds 57*a* and 58*a*, respectively. A roll-forming method for manufacturing the first and second members 57 and 58, as shown in FIGS. 25 to 29, is disclosed in, for example, Japanese Unexamined Patent Application Publication No. 7-314050.

In the roll-forming method, four rolls, which are a pair of upper and lower press-rollers 61 and 62, an inlet assist roller 63 disposed at the inlet side, and an outlet assist roller 64 disposed at the outlet side, are used. A metallic plate 65 is placed in a working position, as shown in FIG. 25. The upper roller 61 moves downward to be pressed to the lower roller 62, thereby pressing so as to hold the metallic plate 65, as shown in FIG. 26. The upper and lower rollers 61 and 62 as a unit pivot in a direction moving the metallic plate 65 away from the inlet assist roller 63, thereby bending the metallic plate 65 at an end thereof, as shown in FIG. 27. The outlet assist roller 64 moves so as to come into contact with the transferred metallic plate 65 at the end thereof, and the upper and lower rollers 61 and 62 are restored to the original position while the upper and lower rollers 61 and 62 rotate so as to transfer the metallic plate 65 toward the outlet side, as shown in FIG. 28. Then, the upper and lower rollers 61 and 62 and the outlet assist roller 64 bend the metallic plate 65, as shown in FIG. 29. The metallic plate 65 is welded at ends thereof (not shown), whereby cylindrical works such as the first and second members 57 and 58 are formed.

However, when the individually manufactured first and second members 57 and 58 are welded so as to form an integral structure, considerable labor and time are required in processes of setting the first and second members 57 and 58 for welding, and sufficient strength cannot be obtained. In addition, the appearance is not good due to the welds of the first and second members 57 and 58 being exposed. Moreover, two sets of bending devices are required because the first and second members 57 and 58 are individually manufactured. Therefore, forging may be used for forming the bearing-receiving unit 53 in an integral structure. However, a forging device is expensive, thereby increasing the cost.

SUMMARY OF THE INVENTION

Accordingly, it is an object of the present invention to provide a low-cost bent work and bending method and a bending device therefor, in which a bent work such as a bearing-receiving unit can be manufactured in an integral structure, thereby omitting welding processes and improving the strength and the appearance of the work, and the bent work can be manufactured by one bending device at low cost.

To these ends, according to a first aspect of the present invention, a bent work is obtained by a method comprising the steps of preparing a belt-shaped thick steel material having an L-shaped cross-section; forming a cylinder by bending the belt-shaped thick steel material having an L-shaped cross-section; and welding ends of the belt-shaped thick steel material formed into the cylinder to each other.

According to a second aspect of the present invention, a bending method comprises the steps of providing a belt-shaped thick steel material having one of an L-shaped cross-section and a U-shaped cross-section; and forming the material into a cylinder by using a center roller to be driven to rotate which is positioned and fixed in a predetermined position and a pair of bending rollers to be driven to rotate which is disposed opposing the center roller at one side of the center roller, movable toward and away from the center roller. The belt-shaped thick steel material having one of an L-shaped cross-section and a U-shaped cross-section is bent by being transferred between the center roller and the pair of bending rollers.

According to a third aspect of the present invention, a bending device, for forming a cylinder by bending a belt-shaped thick steel material, comprises a center roller to be driven to rotate positioned and fixed in a predetermined position; and a pair of bending rollers to be driven to rotate disposed opposing the center roller at one side of the center roller, movable toward and away from the center roller, the belt-shaped thick steel material being bent by being transferred between the center roller and the pair of bending rollers. The center roller is provided with an annular recess formed therein around the center roller. The pair of bending rollers are respectively provided with annular convex portions formed thereon around the bending rollers. The convex portions can be inserted in the annular recess of the center roller at a predetermined position of the annular recess of the center roller. The belt-shaped thick steel material having one of an L-shaped cross-section and a U-shaped cross-section is transferred between the center roller and the pair of bending rollers in a manner such that a concave portion of the belt-shaped thick steel material having one of an L-shaped cross-section and a U-shaped cross-section faces toward the outside at the annular recess of the center roller and the convex portions of the pair of bending rollers are positioned in the concave portion of the belt-shaped thick steel material having one of an L-shaped cross-section and a U-shaped cross-section.

According to the present invention, the bent work is formed by bending a belt-shaped thick steel plate having an L-shaped cross-section and welding the steel plate at the ends thereof, thereby forming a cylinder. The cylinder having an L-shaped section can be manufactured in one bending process. It is not necessary to manufacture first and second members 57 and 58 individually, and to combine the first and second members 57 and 58 by welding, as in a known technology. The welding process of assembling the first and second members 57 and 58 can be omitted, according to the present invention. The strength of the bent work according to the present invention is greater than that of the known work because the bent work according to the present invention is integrally formed. The appearance of the bent work is superior to that of the known work in which the welding points of the first and second members 57 and 58 are exposed. The bent work according to the present invention only requires one bending process using one bending device. Because the bent work according to the present invention is formed by bending, the costs are lower than that work which is formed by forging. The bent work according to the present invention may be most appropriately used as a bearing-receiving unit for construction machinery. The steel material used according to the present invention may be a flat steel plate or may be a rolled plate. The rolled plate has an advantage in that a cutting process and the like for making the bent work according to the present invention into a finished product are simple because the shape of the rolled plate can be made, when rolling, close to that of the finished product. The thick steel material includes a steel plate having a thickness of not less than 20 mm. Therefore, the thick steel material does not include a material such as a steel angle.

By the bending method and by the bending device according to the present invention, a cylinder for forming the bent work, which offers the above-described advantages, can be manufactured. By the bending method and by the bending device according to the present invention, when a U-shaped thick steel plate is used, a cylinder formed by bending the U-shaped thick steel plate may be cut at an intermediate part in a direction perpendicular to the axis thereof into two cylinders, yielding two products each having an L-shaped cross-section.

When the bending device has a configuration in which a pressing roller is rotatably disposed opposing a center roller so as to move toward and away from the center roller and to be inserted in an annular recess formed around the center roller at the periphery of the pressing roller, a highly accurately bent work can be obtained by pressing a thick steel material at a thinner portion thereof by the pressing roller so as to prevent the thick steel material from deformation at the thinner portion thereof.

DESCRIPTION OF THE PREFERRED EMBODIMENTS

Embodiments according to the present invention are described below with reference to the drawings.

Figure 1:
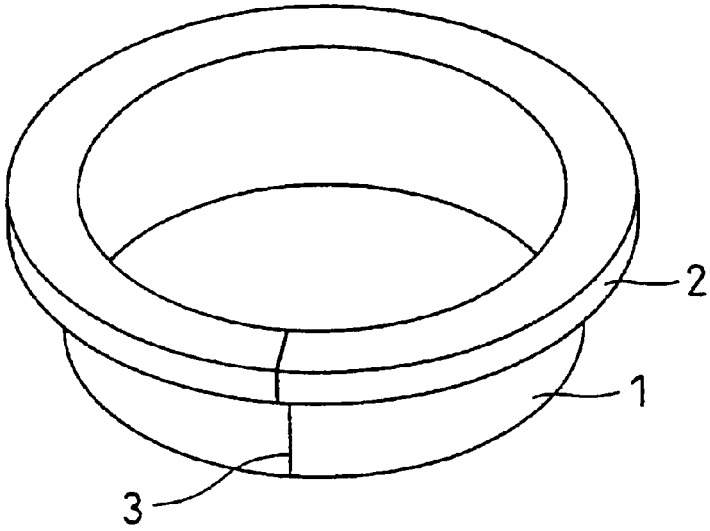
FIG. 1 is a perspective view of a bent work according to an embodiment of the present invention.
Figure 2:
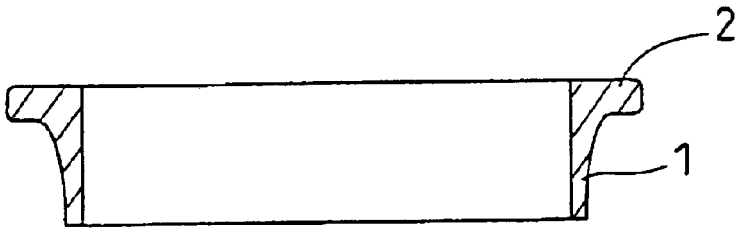
FIG. 2 is a cross-sectional view of the bent work shown in FIG. 1.
Figure 3:
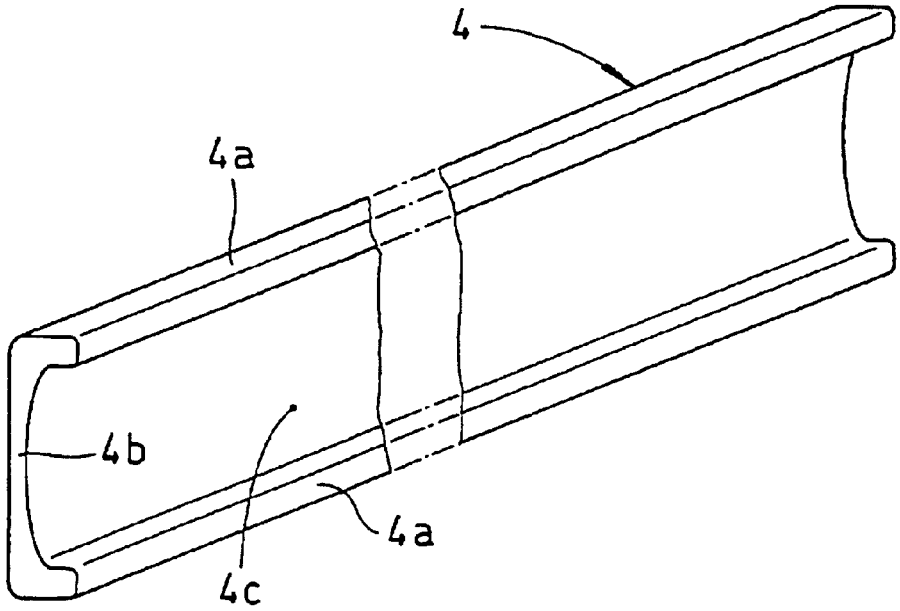
FIG. 3 is a perspective view of a thick steel material.
Figure 4:
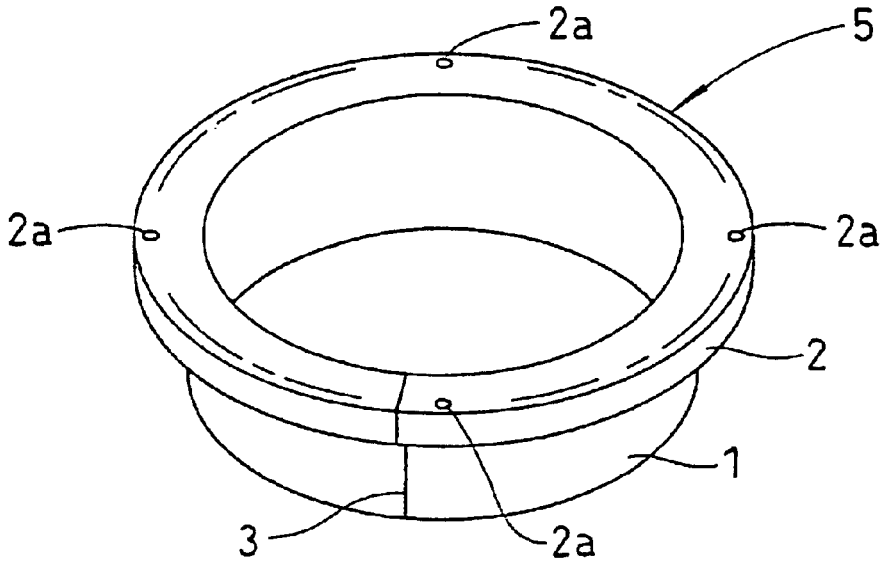
FIG. 4 is a perspective view of a bearing-receiving unit used in a hydraulic shovel.

FIGS. 1 and 2 show a bent work according to an embodiment of the present invention. According to the embodiment, the bent work is manufactured as a bearing-receiving unit 5 (see FIG. 4) for a hydraulic shovel. In these drawings, a cylindrical part 1 is formed in a manner such that the periphery thereof is formed so as to expand to the outside gradually toward the upper portion thereof. A flange 2 is formed protruding toward the outside or outwardly from the periphery of the cylindrical part 1 at the upper portion thereof. A butt-weld 3 is shown in FIGS. 1 and 4. Such a bent work is formed with a material having an L-shaped cross-section bent in a circle and butt-welded at the ends thereof. In particular, a belt-shaped thick rolled steel plate 4 having a U-shaped cross-section as shown in FIG. 3 is bent into a cylinder so that ribs 4*a* of the steel plate 4 are disposed at the outer periphery of the cylinder. The thick rolled steel plate 4 formed in a cylinder then is cut at an intermediate part between the ribs 4*a* in the longitudinal direction thereof. Two cut portions formed in a cylinder are butt-welded at the longitudinal ends of the individual cut-portions, thereby forming two cylinders, each having an L-shaped cross-section.

As is shown in FIG. 3, the thick rolled steel plate 4 in a U-shaped cross-section is thinner at a major portion 4*b* thereof than at the ribs 4*a*. That is, the thickness of the major portion 4*b* increases gradually from an intermediate part between the ribs 4*a* toward the ribs 4*a* so that a concave face 4*c* of the U-shaped steel plate 4 is curved to the outside toward the respective ribs 4*a*. As shown in FIG. 4, the flange 2 is provided with a number of bolt-passing holes 2*a* (four bolt-passing holes 2*a* are shown in FIG. 4) formed therein. The cylinder thus formed is machined at predetermined portions to predetermined sizes, thereby manufacturing the bearing-receiving unit 5 for a hydraulic shovel.

Figure 5:
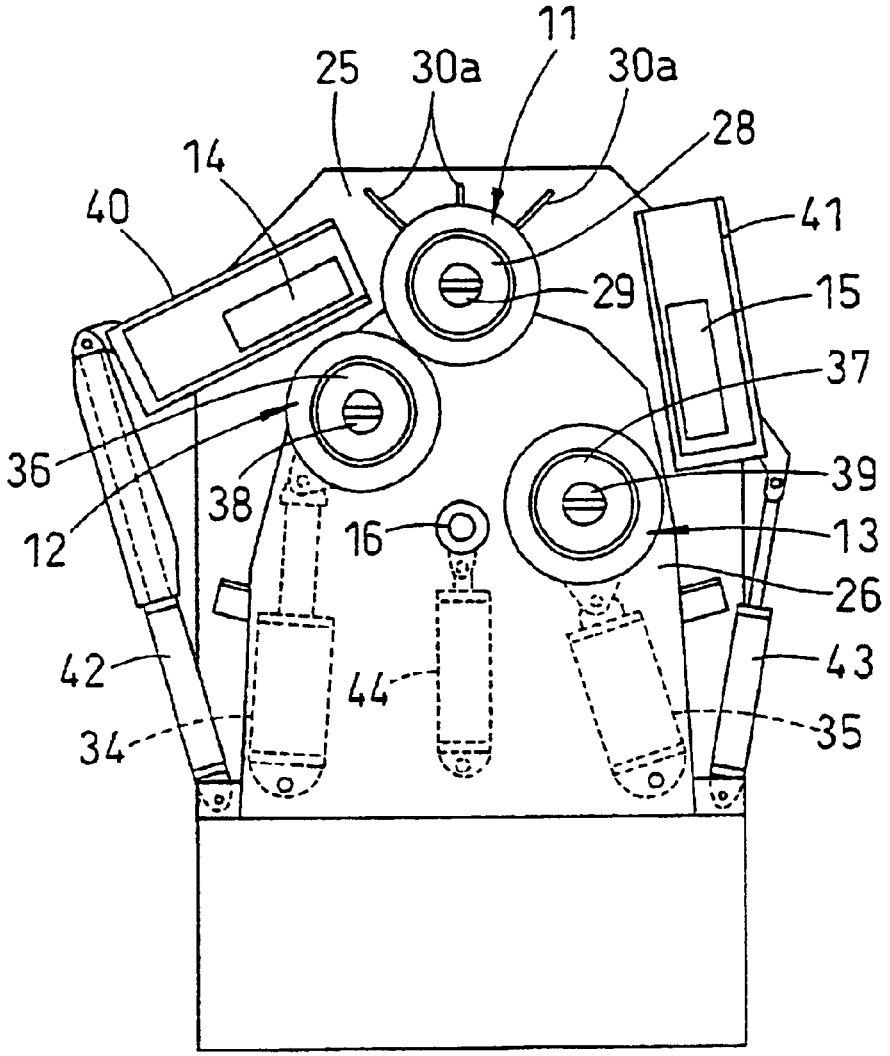
FIG. 5 is a plan view of a bending device.

The cylinder formed by bending the thick steel plate 4 is manufactured by a bending device shown in FIG. 5. The bending device includes a top roller unit (center roller) 11, a pair of bottom roller units (bending rollers) 12 and 13, a pair of supporting rollers 14 and 15, and a pressing roller 16.

Figure 6:
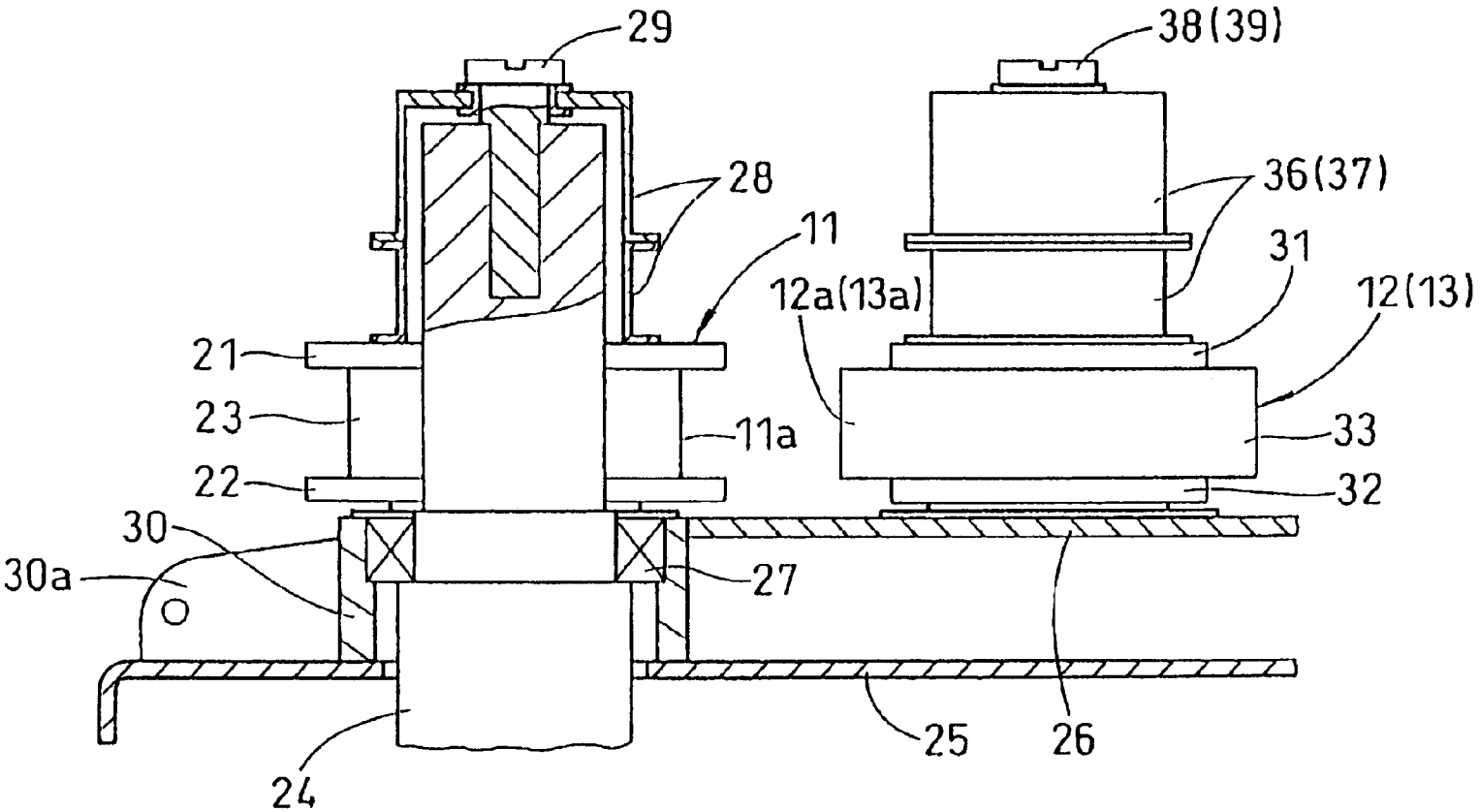
FIG. 6 is an illustration showing an important portion of the bending device shown in FIG. 5.
Figure 7:
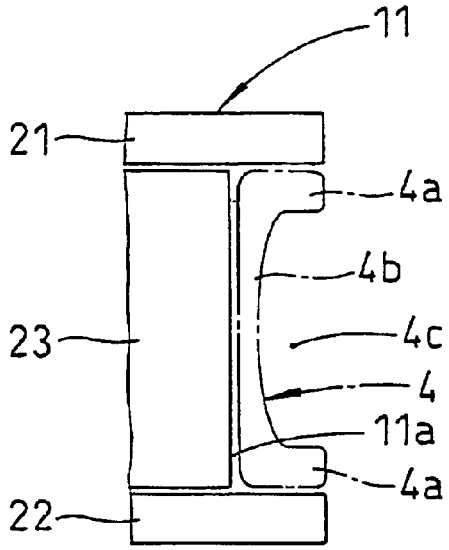
FIG. 7 is an illustration of a top roller used in the bending device shown in FIG. 5.

In FIG. 6, the top roller unit 11 includes a pair of rollers 21 and 22 having the same outer diameters, and an intermediate roller 23 having an outer diameter smaller than those of the pair of rollers 21 and 22, the rollers 21, 22, and 23 being fixed to each other by screws (not shown) or the like. The top roller unit 11 is provided with a recess (annular recess portion) 11*a* formed by the rollers 21 to 23 around the top roller unit 11. The thick rolled steel plate 4 is transferred with the ribs 4*b* thereof in contact with the top roller unit 11 at the corners of the recess 11*a* and with the concave face 4*c* of the rolled steel plate 4 toward the outside (see FIG. 7).

The three rollers 21 to 23 are individually fixed to a top shaft 24. The top shaft 24 is rotatably supported by a lower bearing (not shown) fixed to a bottom plate (not shown) and an upper bearing fixed to a pair of base plates 25 and 26. The top shaft 24 is connected to a hydraulic motor (not shown) at the lower end thereof. An upper cover 28 is provided over the top shaft 24 fixed by a bolt 29. In FIG. 6, a cylindrical cover 30 is fixed to the upper and lower base plates 25 and 26. The upper bearing 27 is fixed to the cylindrical cover 30 at the upper part thereof. A rib 30*a* extends from the cylindrical cover 30.

Figure 8:
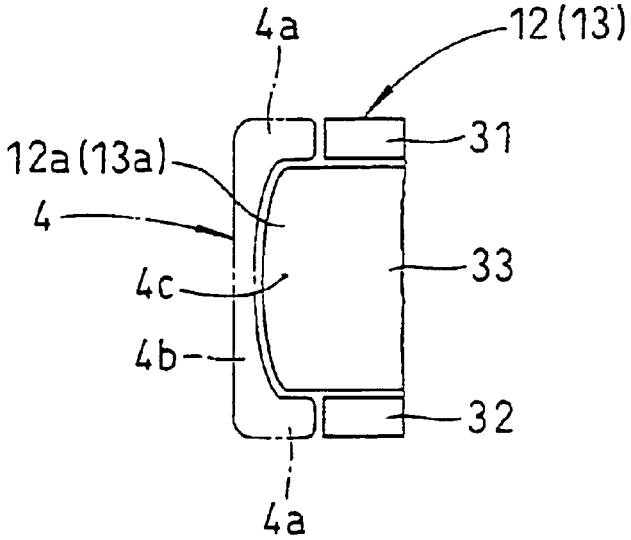
FIG. 8 is an illustration of a bottom roller used in the bending device shown in FIG. 5.

As illustrated in FIG. 6, each of the bottom roller units 12 and 13 includes a pair of rollers 31 and 32 having the same outer diameter, and an intermediate roller 33 having an outer diameter greater than those of the pair of rollers 31 and 32, the rollers 31, 32, and 33 being fixed to each other by screws (not shown) or the like. The outer periphery of the intermediate roller 33 is formed so as to mate with the concave face 4*c* between the ribs 4*b* of the thick rolled steel plate 4. The bottom roller units 12 and 13 are provided with convex portions (annular convex portions) 12*a* and 13*a*, respectively, formed by the rollers 31 to 33 around the peripheries of the bottom roller units 12 and 13, respectively. The thick rolled steel plate 4 is transferred with the major portion 4*a* and the ribs 4*b* thereof in contact with the bottom roller units 12 and 13 at the convex portions 12*a* and 13*a* thereof, respectively, in a manner such that the convex portions 12*a* and 13*a* are disposed in a recess of the steel plate 4 formed with the ribs 4*b* and the major portion 4*a* thereof (see FIG. 8).

The rollers 31 to 33 of each bottom roller unit 12 or 13 are respectively fixed to a bottom shaft (not shown). The bottom shafts, to which the rollers 31 to 33 of the bottom roller units 12 and 13 are fixed, are connected to individual hydraulic motors (not shown), whereby the bottom shafts are driven so as to rotate. The two bottom shafts are connected individually to cylinders 34 and 35, whereby the bottom roller units 12 and 13 are capable of individual movement directly toward and away from the top roller unit 11. In FIG. 5, covers 36 and 37 are fixed by screws 38 and 39, respectively, at the upper parts of the bottom shafts of the bottom roller units 12 and 13, respectively.

The supporting rollers 14 and 15 are rotatably mounted on shafts (not shown) fixed to receiving cases 40 and 41, respectively. The receiving cases 40 and 41 are connected to pivoting cylinders 42 and 43, respectively, whereby the supporting rollers 14 and 15 can be moved in a horizontal direction toward and away from the bottom roller units 12 and 13, respectively. The supporting rollers 14 and 15 can also move vertically by actuation of cylinders (not shown) disposed in directions to that effect.

The pressing roller 16 is rotatably disposed opposing the top roller unit 11. The pressing roller 16 presses the thick rolled steel plate 4 at the major portion 4*b* thereof, which is thinner than the ribs 4*a*, the rolled steel plate 4 being transmitted at the recess 11*a* of the top roller unit 11, so that the thick rolled steel plate 4 is not deformed during bending. The pressing roller 16 is connected to a cylinder 44, whereby the pressing roller 16 can be moved directly toward and away from the top roller unit 11.

Figure 9:
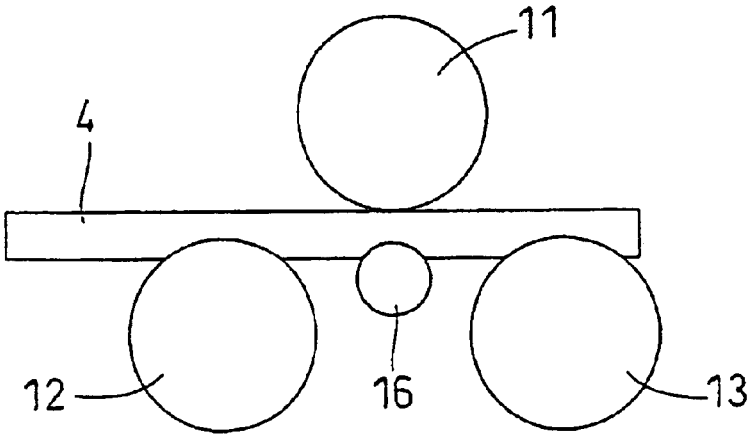
FIG. 9 is an illustration showing an operation of the bending device shown in FIG. 5.
Figure 10:
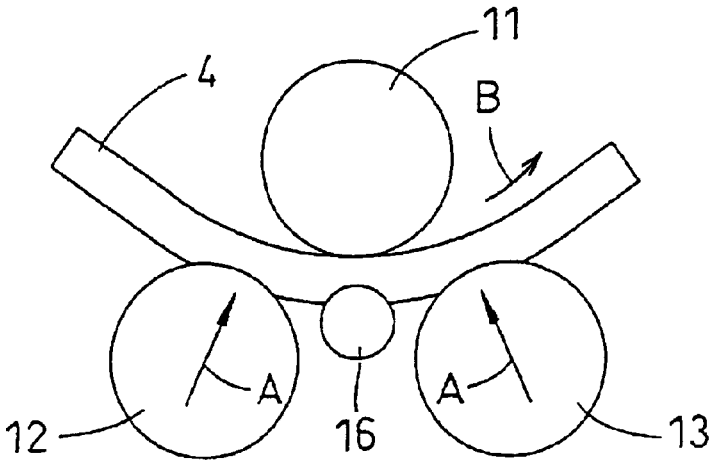
FIG. 10 is an illustration showing another operation of the bending device shown in FIG. 5.
Figure 11:
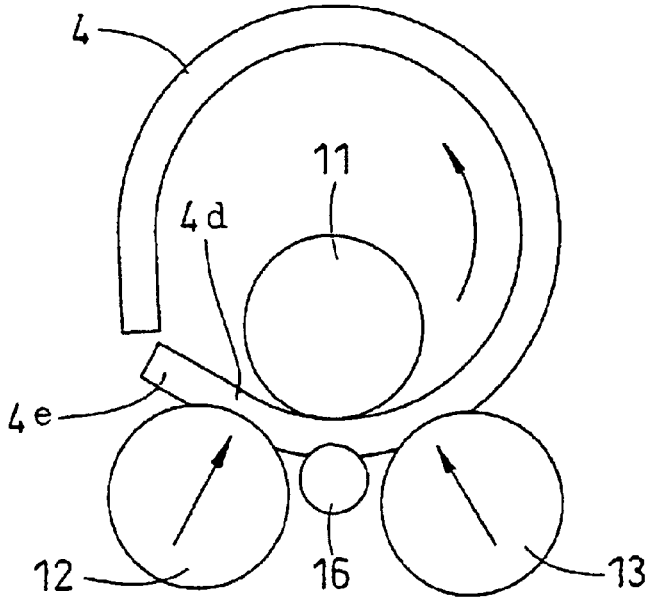
FIG. 11 is an illustration showing another operation of the bending device shown in FIG. 5.
Figure 12:
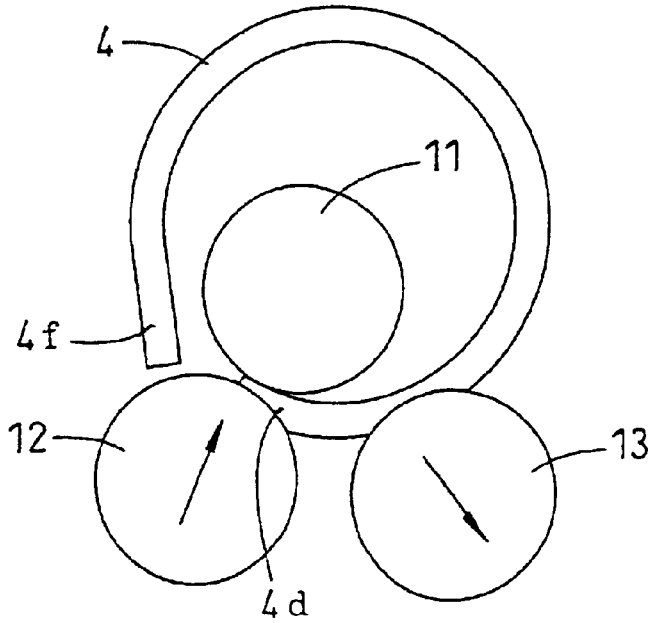
FIG. 12 is an illustration showing another operation of the bending device shown in FIG. 5.
Figure 13:
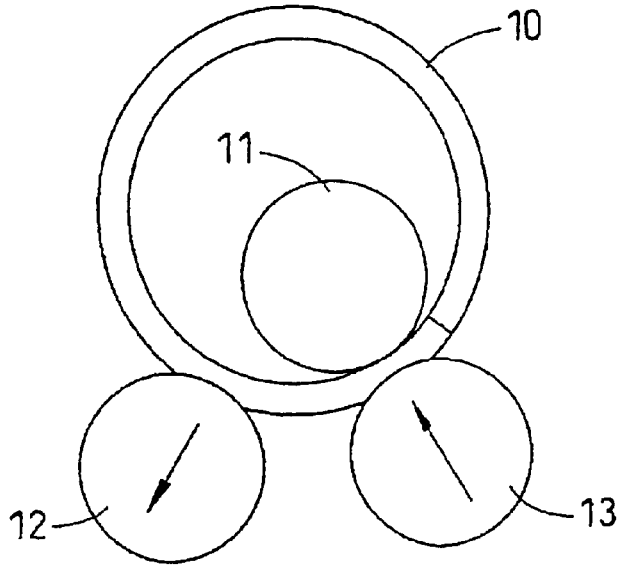
FIG. 13 is an illustration showing another operation of the bending device shown in FIG. 5.
Figure 14:
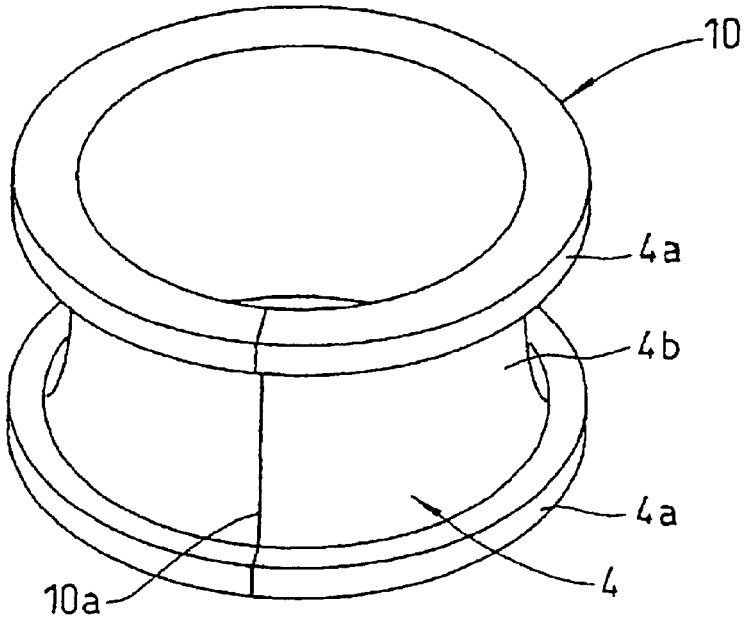
FIG. 14 is a perspective view of a cylindrical work formed by the bending device shown in FIG. 5.
Figure 15:
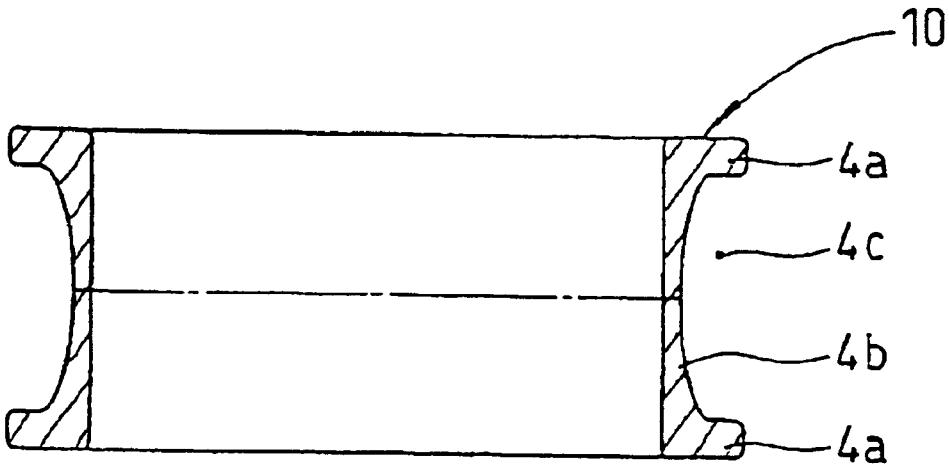
FIG. 15 is a cross-sectional view of the cylindrical work shown in FIG. 14.

With the configuration described above, when a bent work is manufactured, the top roller unit 11, the bottom roller units 12 and 13, and the pressing roller 16 are positioned accordingly, the thick belt-shaped rolled steel plate 4 having a U-shaped cross-section is transferred by a forklift truck or the like (not shown), and the rolled steel plate 4 is charged from the side of the bottom roller unit 12 between the top roller unit 11, the bottom roller units 12 and 13, and the pressing roller 16, as shown in FIG. 9. In this case, the thick rolled steel plate 4 is positioned at the recess 11*a* of the top roller unit 11, at the convex portions 12*a* and 13*a* of the bottom roller units 12 and 13, respectively, and at the periphery of the pressing roller 16. The thick rolled steel plate 4 is supported at the lower thereof by the supporting rollers 14 and 15. In FIG. 10, the bottom roller units 12 and 13 are moved toward the top roller unit 11 in directions A while the rollers 11 to 13 are driven so as to rotate, whereby the thick rolled steel plate 4 moves in a direction B so as to be formed into a circle. When a point 4*d* adjacent to an end portion 4*e* of the thick rolled steel plate 4 reaches the bottom roller unit 12, as shown in FIG. 11, a straight part of the end portion 4*e* is-cut away and the portion adjacent point 4*d* is bent in a arc, as shown in FIG. 12. In this case, the bottom roller unit 13 and the pressing roller 16 are withdrawn (the pressing roller 16 is not shown in FIG. 12). Then, the rollers 11 to 13 rotate in a reverse direction, and a portion 4*f* adjacent to the other end portion of the thick rolled steel plate 4 is bent in a arc in the same manner as the portion adjacent point 4*d* described above, whereby a cylinder 10 is formed, as shown in FIG. 13 (the pressing roller 16 is not shown in FIG. 13). The cylinder 10 thus formed is shown in FIGS. 14 and 15. The cylinder 10 having a U-shaped cross-section is cut at an intermediate part of the major portion 4*b* in a direction perpendicular to the axis thereof along a dashed line shown in FIG. 15. Two cut parts of the cylinder 10 are individually butt-welded at the longitudinal ends of each cut part of the cylinder 10, whereby two bent works are manufactured, one of which is shown in FIG. 1. The longitudinal ends of the thick rolled steel plate 4 forming the cylinder 10 are shown by line 10*a* in FIG. 14.

The cylinder 10 for forming two bearing-receiving units 5 for a hydraulic shovel is formed by bending the belt-like thick rolled steel plate 4 having a U-shaped cross-section by using one bending machine in one bending process in which welding is minimized. The thick rolled steel plate 4 thus forming the cylinder 10 is cut into two pieces in the longitudinal direction of the thick rolled steel plate 4, and each piece is butt-welded to itself at the longitudinal ends thereof. Each obtained bent work is strong, has a superior appearance, and has a low cost.

Figure 16:
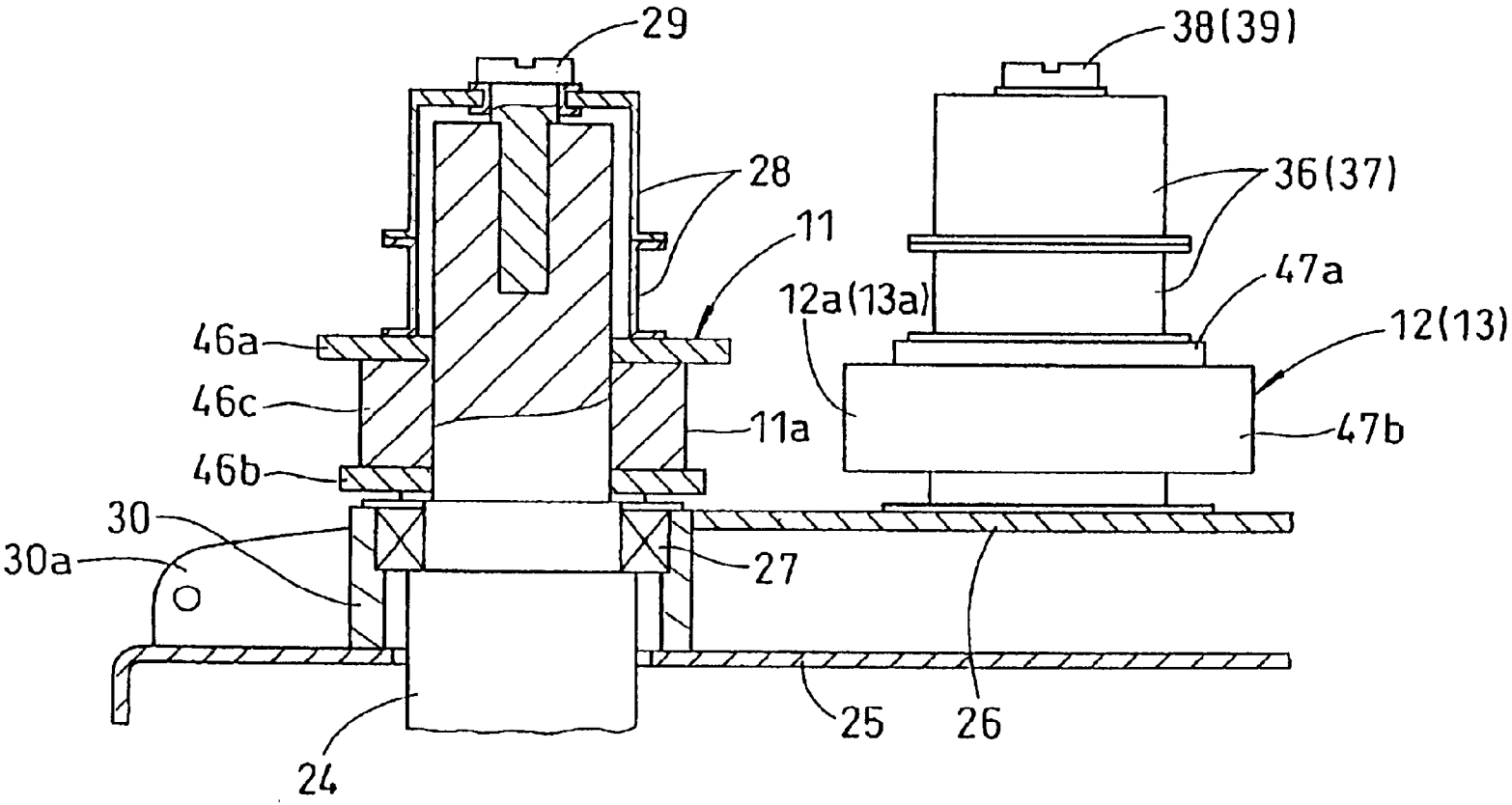
FIG. 16 is an illustration of an important portion of a modified example of the bending device shown in FIG. 5.
Figure 17:
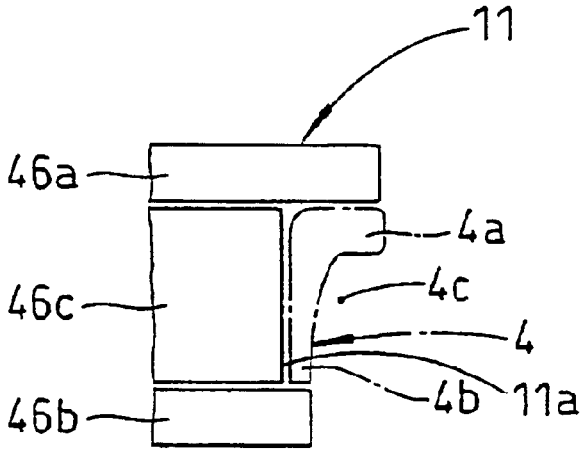
FIG. 17 is an illustration of a top roller used in the bending device shown in FIG. 16.

FIG. 16 shows a modified example of the bending device according to the invention. In this embodiment of the bending device, a thick rolled steel plate 4 having an L-shaped cross-section is used, as shown in FIG. 17. The top roller unit 11 includes an upper roller 46*a,* a lower roller 46*b* having an outer diameter smaller than that of the upper roller 46*a,* and an intermediate roller 46*c* having an outer diameter smaller than that of the lower roller 46*b,* the rollers 46*a,* 46*b,* and 46*c* being fixed to each other by screws or the like (not shown). The top roller unit 11 is provided with a recess 11*a* formed by the rollers 46*a,* 46*b,* and 46*c* around the periphery of the top roller unit 11. The thick rolled steel plate 4 having an L-shaped cross-section is transferred with a vertical end 4*b* thereof in contact with the top roller unit 11 at a corner of the recess 11*a* and with a concave face 4*c* of the rolled steel plate 4 toward the outside (see FIG. 17). In FIG. 17, a horizontal end 4*a* of the L-shaped thick rolled steel plate 4 is disposed at the end thereof opposite to the vertical end 4*b*.

Figure 18:
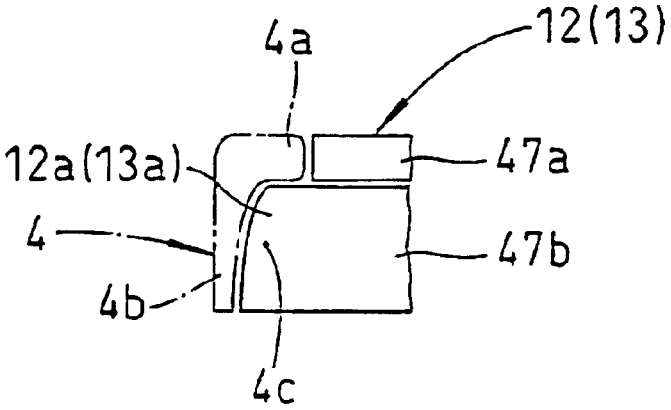
FIG. 18 is an illustration of a bottom roller used in the bending device shown in FIG. 16.
Figure 19:
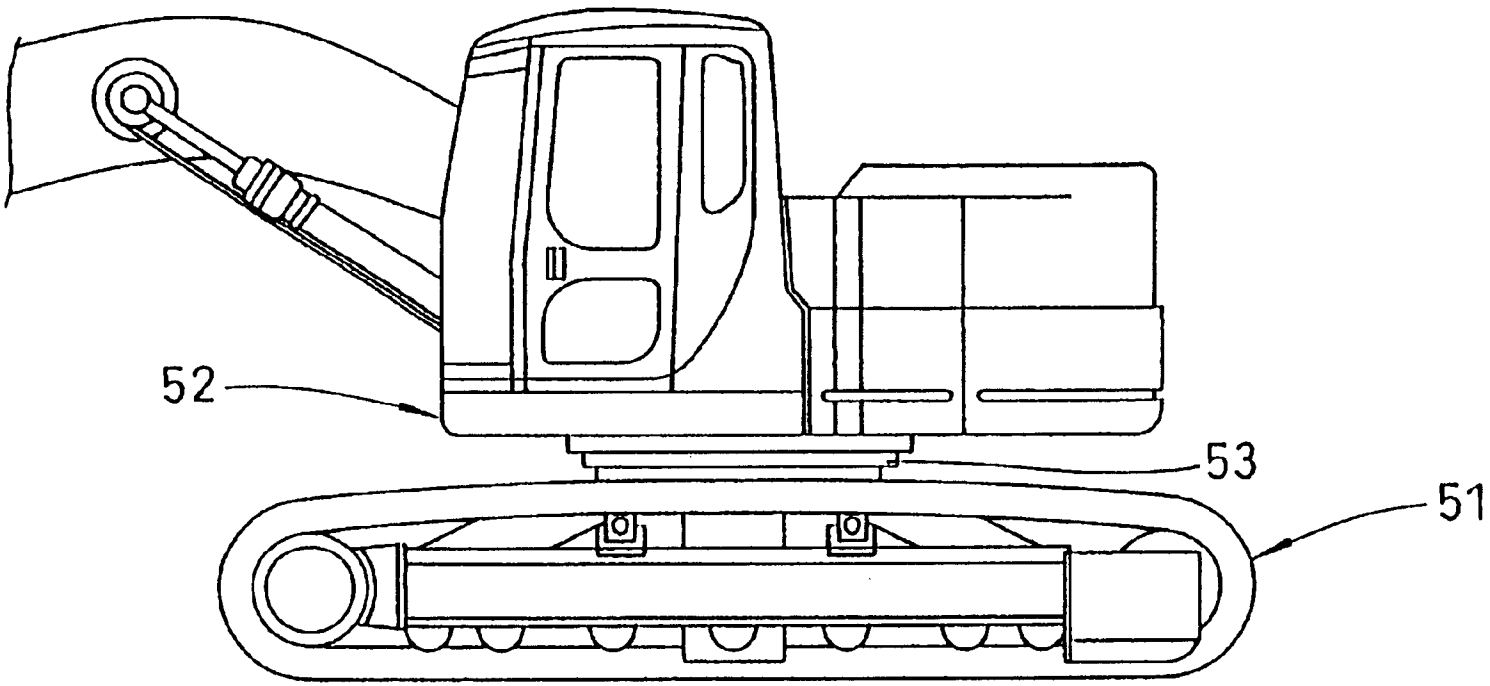
Fig. 19 PRIOR ART
FIG. 19 is a perspective view of a bearing-receiving unit used in a hydraulic shovel.
Figure 20:
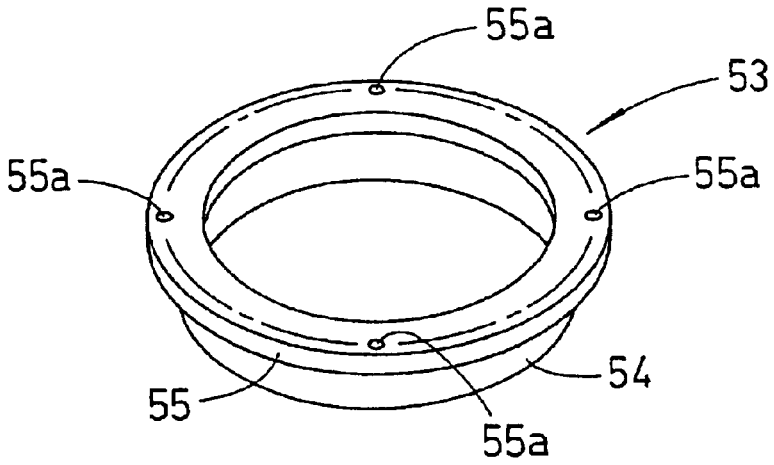
Fig. 20 PRIOR ART
FIG. 20 is a perspective view of a known bearing-receiving unit used in a hydraulic shovel.
Figure 21:
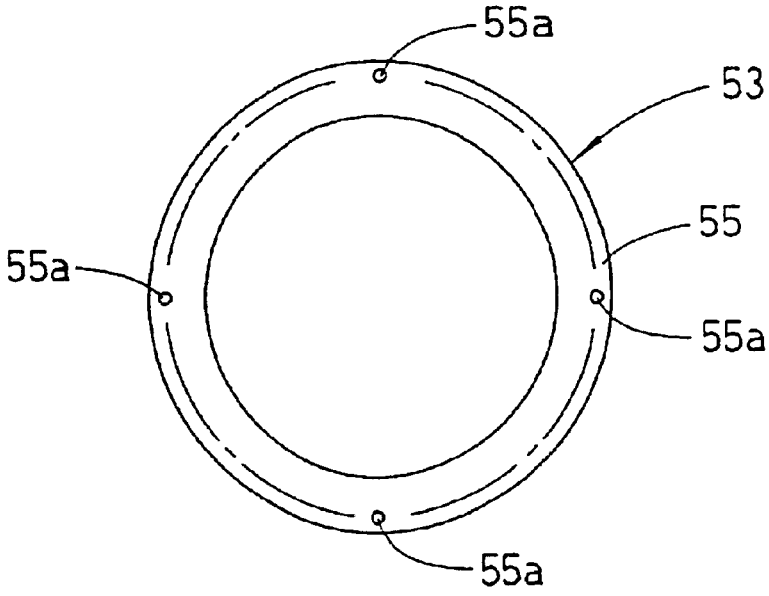
Fig. 21 PRIOR ART
FIG. 21 is a plan view of the known bearing-receiving unit shown in FIG. 20.
Figure 22:
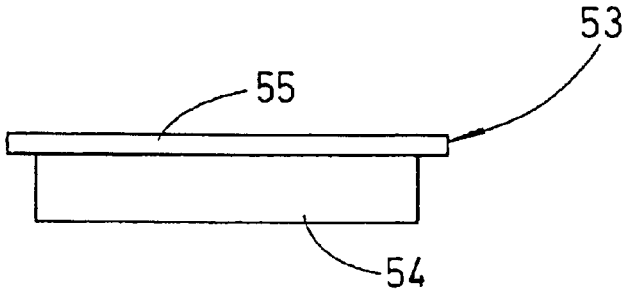
Fig. 22 PRIOR ART
FIG. 22 is a front view of the known bearing-receiving unit shown in FIG. 20.
Figure 23:
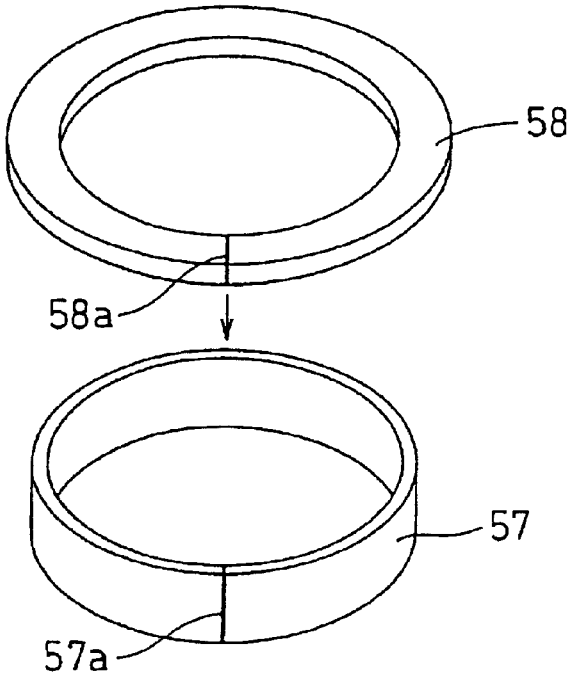
Fig. 23 PRIOR ART
FIG. 23 is a perspective view of a first member and a second member forming the known bearing-receiving unit shown in FIG. 20.
Figure 24:
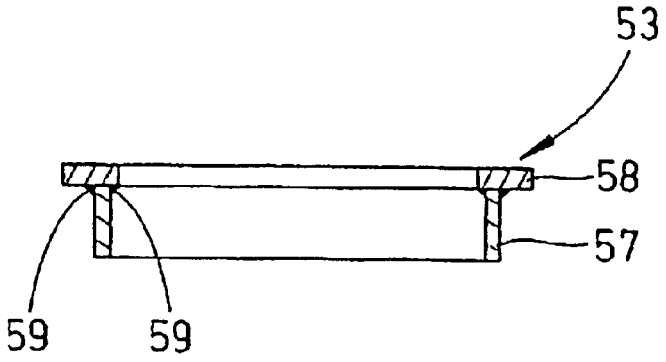
Fig. 24 PRIOR ART
FIG. 24 is a cross-sectional view of the known bearing-receiving unit integrally formed with the first and second members welded to each other.
Figure 25:
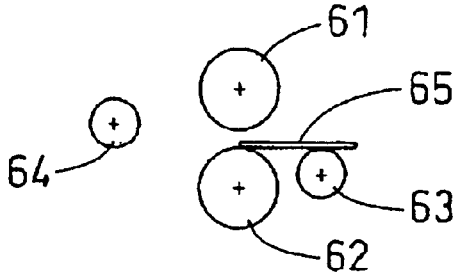
Fig. 25 PRIOR ART
FIG. 25 is an illustration showing a known roll-forming method.
Figure 26:
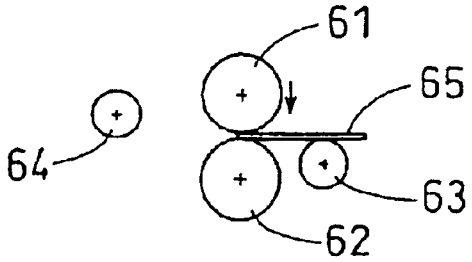
Fig. 26 PRIOR ART
FIG. 26 is an illustration showing the known roll-forming method.
Figure 27:
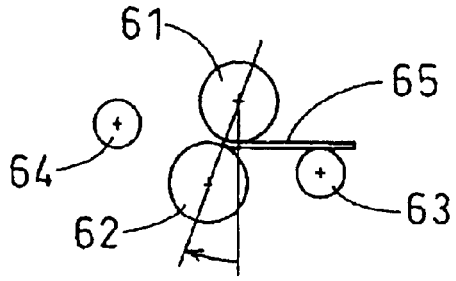
Fig. 27 PRIOR ART
FIG. 27 is an illustration showing the known roll-forming method.
Figure 28:
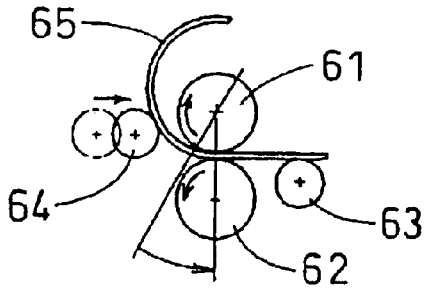
Fig. 28 PRIOR ART
FIG. 28 is an illustration showing the known roll-forming method.
Figure 29:
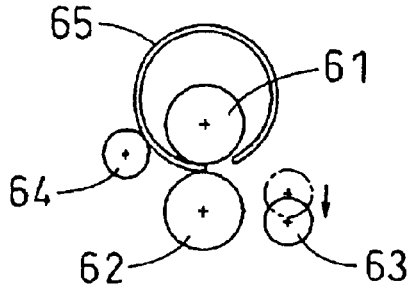
Fig. 29 PRIOR ART
FIG. 29 is an illustration showing the known roll-forming method.

Each of the bottom roller units 12 and 13 includes an upper roller 47*a,* and a lower roller 47*b* having an outer diameter greater than that of the upper roller 47*a,* the rollers 47*a* and 47*b* being fixed to each other by screws or the like (not shown). Each bottom roller unit 12 or 13 is provided with a convex portion 12*a* or 13*a,* respectively, formed around the periphery thereof. The thick rolled steel plate 4 is transferred with the horizontal end 4*a* and the vertical end 4*b* thereof in contact with the bottom roller units 12 and 13 at the convex portions 12*a* and 13*a* thereof, respectively, in a manner such that the convex portions 12*a* and 13*a* are inserted in the concave face 4*c* of the L-shaped rolled steel plate 4 (see FIG. 18). Other arrangements are the same as that in the case in which the U-shaped rolled steel plate 4 is used as described previously with reference to FIGS. 1 to 15. The same reference numerals are used for describing the same or similar components as those used in that embodiment.

By using this modified embodiment of the bending device, one cylinder having an L-shaped cross-section can be manufactured. The same effects can be obtained in the same operation as that in the case in which the U-shaped rolled steel plate 4 is used.

The top roller unit 11 and the bottom roller units 12 and 13 used in the bending device according to the present embodiments may be individually formed as an integral unit instead being an assembly of a plurality of component rollers.

According to the present invention, as described in the embodiments, the bent work is formed by bending a belt-shaped thick steel plate having an L-shaped cross-section and butt-welding the steel plate at the ends thereof, thereby forming a cylinder. The cylinder having an L-shaped section can be manufactured in one bending process. Consequently, it is not necessary to manufacture the first and second members 57 and 58 individually, and to combine the first and second members 57 and 58 by welding, as in a known technology. Therefore, the welding process of assembling the first and second members 57 and 58 can be omitted. Furthermore, the strength of the bent work according to the present invention is greater than that of the known work because the bent work according to the present invention is integrally formed. The appearance of the bent work is superior to that of the known work in which welding points of the members 57 and 58 are exposed. The bent work according to the present invention only requires one bending process using one bending device. Because it is formed by bending, it has lower costs than that which is formed by forging. The bent work according to the present invention is most appropriately used as a bearing-receiving unit for construction machinery.

In the bending method and by using the bending device according to the present invention, a cylinder for forming the bent work, which offers the above-described advantages, can be manufactured. By the bending method and by the bending device according to the present invention, when a U-shaped thick steel plate is used, the U-shaped thick steel plate which is bent so as to be formed in a cylinder is cut into two pieces in the longitudinal direction of the U-shaped thick steel plate at a widthwise intermediate part thereof, each resultant piece has an L-shaped cross-section.

When the bending device has a configuration in which a pressing roller is rotatably disposed opposing the center roller so as to move toward and away from the center roller and to be inserted in an annular recess formed around the center roller at the periphery of the pressing roller, a highly accurately bent work can be obtained by pressing a thick steel plate at a thinner portion thereof by the pressing roller so as to prevent the thick steel plate from deformation at the thinner portion thereof.

What is claimed is:

1. A bent work used as a bearing-receiving unit for construction machinery and manufactured by a method comprising the steps of:

preparing a belt-shaped thick steel material having an L-shaped cross-section and having two elongated sides and two ends; and forming a cylinder by bending the belt shaped thick steel material by means of a center roller, a pair of bending rollers for bending the belt-shaped thick steel material, transferred along the center roller, which is disposed opposing the center roller at one side of the center roller, and a pressing roller for pressing the belt-shaped thick steel material, which is disposed opposing the center roller at one side of the center roller and positioned between the pair of the bending rollers, so that the ends of the belt-shaped thick steel material abut each other.

2. A bending method comprising the steps of:

providing a belt-shaped thick steel material having one of an L-shaped cross-section and a U-shaped cross-section and having two elongated sides and two ends; and forming the material into a cylinder so that the ends of the belt-shaped thick steel material abut each other by using a center roller to be driven to rotate which is positioned and fixed in a predetermined position, and a pair of bending rollers to be driven to rotate which is disposed opposing the center roller at one side of the center roller, movable toward and away from the center roller, and a pressing roller for pressing the belt-shaped thick steel material, transferred along the center roller, which is disposed opposing the center roller at one side of the center roller and positioned between the pair of bending rollers, the belt-shaped thick steel material being bent by being transferred between the (a) center roller and (b) the pair of bending rollers and the pressing roller, the bent work thereby obtained being used as a bearing receiving unit for construction machinery.

3. A bending device for bending a belt-shaped thick steel material having two elongated sides and two ends to form a cylinder where the ends of the belt-shaped thick steel material abut each other, the bent work thereby obtained being used as a bearing receiving unit for construction machinery, the bending device comprising:

a center roller to be driven to rotate positioned and fixed in a predetermined position; and a pair of bending rollers to be driven to rotate disposed opposing the center roller at one side of the center roller, movable toward and away from the center roller, and a pressing roller rotatably disposed opposing the center roller at one side of the center roller, movable toward and away from the center roller, the belt-shaped thick steel material being bent by being transferred between (a) the center roller and (b) the pair of bending rollers and the pressing roller, wherein the center roller is provided with an annular recess formed therein around the center roller, the pair of bending rollers are respectively provided with annular convex portions formed thereon around the bending rollers, the convex portions to be inserted in the annular recess of the center roller at a predetermined position of the annular recess of the center roller, and the belt-shaped thick steel material having one of an L-shaped cross-section and a U-shaped cross-section is transferred between (a) the center roller and (b) the pair of bending rollers and the pressing roller in a manner such that a concave portion of the belt-shaped thick steel member having one of an L-shaped cross-section and a U-shaped cross-section faces toward the outside at the annular recess of the center roller and the convex portions of the pair of bending rollers and a periphery of the pressing roller are positioned in the concave portion of the belt-shaped thick steel material.

* * * * *